US006138306A

United States Patent [19]

Muhanna

[11] Patent Number: 6,138,306

[45] Date of Patent: Oct. 31, 2000

[54] BACKBOARD ASSEMBLY WITH INFLATABLE PAD

[76] Inventor: Nabil L. Muhanna, 2128 Valley Rd., Gainesville, Ga. 30501

[21] Appl. No.: 09/169,519

[22] Filed: Oct. 9, 1998

Related U.S. Application Data

[60] Provisional application No. 60/076,522, Mar. 2, 1998, and provisional application No. 60/086,974, May 28, 1998.

[51] Int. Cl.[7] ..... A47C 27/10; A61G 1/00

[52] U.S. Cl. ..... 5/706; 5/626; 5/628; 5/644; 5/648; 5/691; 5/731; 128/870

[58] Field of Search ..... 5/625, 626, 628, 5/691, 706, 903, 644, 648, 731; D12/128, 133; 128/869, 870

[56] References Cited

U.S. PATENT DOCUMENTS

| | | | |
|---|---|---|---|
| D. 258,481 | 3/1981 | Kroll | D6/201 |
| D. 312,992 | 12/1990 | Liebman | D12/128 |
| D. 379,784 | 6/1997 | Muhanna et al. | D12/128 |
| 2,703,416 | 3/1955 | Owen | 5/348 |
| 4,097,038 | 6/1978 | Jansen . | |
| 4,442,838 | 4/1984 | Samson et al. | 5/706 |
| 4,454,615 | 6/1984 | Whitney | 5/691 |
| 4,723,329 | 2/1988 | Vaccaro | 5/731 |
| 4,736,474 | 4/1988 | Moran et al. | 5/706 |
| 4,872,229 | 10/1989 | Brady | 5/455 |
| 4,908,895 | 3/1990 | Walker | 5/713 |
| 5,097,552 | 3/1992 | Viesturs | 5/903 |
| 5,182,825 | 2/1993 | Stinson et al. | 5/625 |
| 5,317,770 | 6/1994 | Sakurai | 5/625 |
| 5,745,939 | 5/1998 | Flick et al. | 5/731 |
| 5,774,916 | 7/1998 | Kurhi | 5/632 |
| 5,974,608 | 11/1999 | Haller et al. | 5/709 |

FOREIGN PATENT DOCUMENTS

| | | | |
|---|---|---|---|
| 2549366 | 1/1985 | France | 5/625 |
| 1911437 | 11/1969 | Germany | 5/706 |
| 2928629 | 1/1981 | Germany | 5/625 |

OTHER PUBLICATIONS

Back Raft—Everyone Should Be Transported by Air!—MedicTech Emergency Medical Products—Undated Brochure.

*Primary Examiner*—Alexander Grosz
*Attorney, Agent, or Firm*—Womble Carlyle Sandridge & Rice

[57] ABSTRACT

The invention comprises an inflatable pad for releasable attachment to a backboard to provide cushioned support to substantially an entire human body. The inflatable pad comprises a pad body having a length, a top end and a bottom end, a first side and a second side, and a selectively inflatable air retaining chamber integrated with said pad body. The inflatable pad includes an airtight interior for which a compressed air source is provided which selectively rapidly inflates the interior of the inflatable pad to provide cushioning of a person being carried upon the backboard without comprising the immobilization of the person. The inflatable pad is alternatively comprised of various sections specifically contoured to support the head, back, and legs of a person placed thereupon, and alternatively includes an integrated head restraining means.

23 Claims, 7 Drawing Sheets

BACKBOARD ASSEMBLY WITH INFLATABLE PAD

CROSS-REFERENCE TO RELATED APPLICATION

This application claims the benefit of U.S. Provisional Application No. 60/076,522, filed Mar. 2, 1998, and U.S. Provisional Application No. 60/086,974, filed May 28, 1998.

BACKGROUND OF THE INVENTION

1. Field Of The Invention

The present invention relates generally to backboards (sometimes referred to as "rigid stretchers"). More specifically, the present invention relates to padded backboards and to pads used to cushion backboards.

2. Description Of The Related Art

It is common to immobilize an injured person on a backboard (or "rigid stretcher") such that the person can be transported to an emergency facility without subjecting that person to any additional trauma from being carried. However, the hard surface of the backboard has been known to cause additional trauma including soft tissue injury, to a person being carried upon it. Thus, it is desirous to incorporate padding on the surface of the backboard such that the person being carried upon it is cushioned, and will not suffer additional trauma, yet will be sufficiently immobilized for transportation to the emergency facility.

It has previously been known to place a blanket under the person being placed upon the backboard prior to that person being strapped to the backboard. However, the blanket may slip from under the person or cause significant discomfort by shifting its position.

Further attempts at addressing this problem have required padding to be affixed to the surface of the backboard, however, such padding increases the bulk and weight of the stretcher which significantly affects the storage capability which has a significant effect when space is at a premium, such as in an ambulance. Moreover, it is difficult to determine the correct amount of padding for softening the transport of the patient yet still immobilize the patient to prevent further injury.

SUMMARY OF THE INVENTION

Briefly described, the present invention comprises a backboard assembly which includes a backboard and an inflatable pad releasably secured to the backboard. In the preferred embodiment, the pad includes one or more straps to selectively bind the pad to the backboard. In an alternate embodiment, the backboard (on its top) and the pad (on its bottom) are outfitted with matching fasteners, such as hook-and-loop fasteners (VELCRO® being an example), which function, preferably in combination with the mentioned strap(s) to secure the pad to the backboard. In still other alternate embodiments, the pad has fitted sleeves about its ends that slide over the respective ends of a backboard, thereby securing the pad to the backboard, again, preferably, in combination with the mentioned straps. Various combinations of these securing devices are acceptable. Further, a compressed air delivery system is, preferably, provided to rapidly inflate the interior of the pad which provides sufficient cushioning for a person immobilized on the backboard.

In use, the pad, preferably uninflated, is placed on the backboard and a strap on the pad is affixed around the backboard. If present, the hook-and-loop fasteners are aligned and/or fitted ends of the pad are respectively placed over the ends of a backboard. Once in place, the compressed air system is activated to inflate the interior of the pad. Such inflation of the pad further tightens the straps and causes the fitted ends, if present to frictionally embrace the ends of the backboard. Once inflated, a person can be placed on top of the pad to be immobilized on the backboard while the inflated pad configuration assists in maintaining the body structure in position and cushioning the body to prevent soft tissue damage, or other injury.

The inflatable pad is preferably made from a durable lightweight material, such as plastic. When so constructed, the pad is easily compressed for transport and storage purposes.

In accordance with preferred embodiments, the shape of the pad and the sizing of the fitting sleeves are matched to the shape and size of the backboard to define an integrated backboard-pad combination/system. The pad is, preferably, washable, reusable, or alternatively, disposable (in the event of contamination, for example), and replaceable. The pad is alternately longitudinally shaped through compartments of varying sizes to alter the support to the head, thoracic and lumbar areas of the back, and the extremities. Further, the compartments next to the head alternately are used to brace the head during transport.

The inflatable pad of the present invention is, furthermore, comprised of features which render the pad of the present invention separately inventive, finding usefulness in other environments such as, without limitation, cardiac angiogram tables, tanning beds, and similar hard surface beds and tables.

Therefore, the primary object of the present invention is to provide a backboard with an inflatable pad which easily secures to the backboard providing support and cushioning for a person being carried on the backboard without compromising the immobilization function of the backboard.

It is another object of the present invention to provide an inflatable pad which can be placed on a backboard either before or after inflation.

It is a further object of the present invention to provide cushioned support to various sections of the body.

It is yet another object of the present invention to provide immobilization of the head and neck of an injured person during transport.

Other objects, features and advantages of the present invention will become apparent after review of the hereinafter set forth Brief Description of the Drawings, Detailed Description of the Preferred Embodiment, and claims appended herewith.

DETAILED DESCRIPTION OF THE PREFERRED EMBODIMENT

Figure 1:
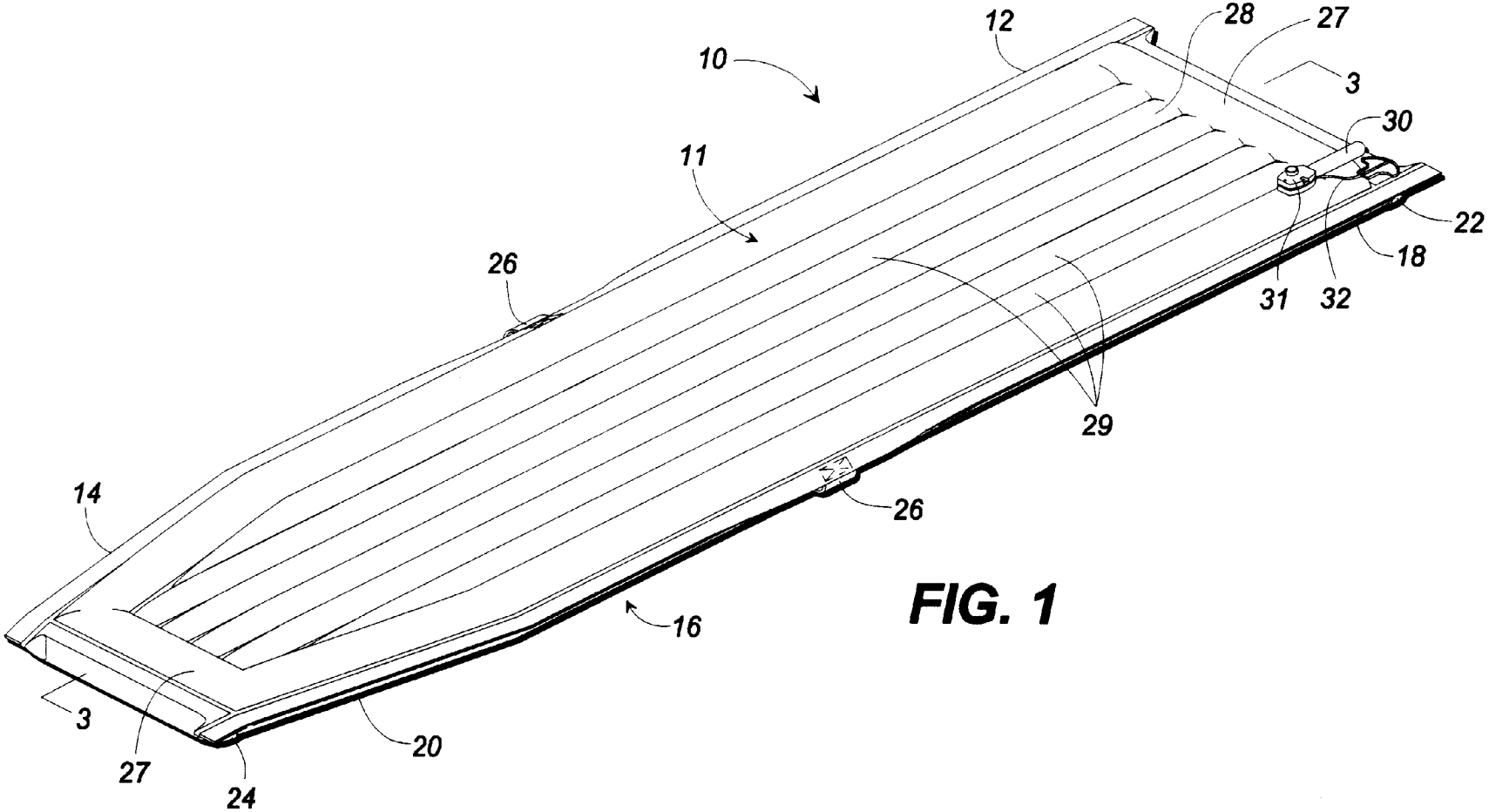
FIG. 1 is a perspective view of a backboard assembly in accordance with the present invention and illustrating one embodiment of an inflatable pad attached to a backboard.

Referring now in more detail to the drawings, in which like numerals represent like components throughout the several views, FIG. 1 depicts a backboard assembly 10, in accordance with one preferred embodiment of the present invention, including a rigid backboard 16 and an inflatable pad 11 attached to the backboard 16. While a specific backboard is illustrated herein, it should be apparent that the inflatable pad 11 can be combined with other rigid stretchers. The inflatable pad 11 has an airtight interior, and a first end 12 and second end 14, and, in the embodiment of FIG. 1, each end respectively includes fitting sleeves 22, 24 which slidably fit about the respective ends of a backboard. The inflatable pad 11 is generally planar and has a generally rectangular shape, and is here embodied as having the second end 14 tapered to compliment the taper of a second end 20 of a backboard 16.

The inflatable pad 11 is preferably defined by an outer pad structure (or pad body) made from plastic, although any other durable pliant material such as nylon, cloth, or combinations thereof, is alternatively used. As here embodied, it is important, however, that the material be non-porous (or have a bladder) such that the interior of the inflatable pad 11 is airtight and can be inflated.

The inflatable pad 11 includes an air retaining system 28 (also referred to herein as the air retaining chamber structure) embodied herein as an airtight chamber which is integrated with (and within) the pad structure of the inflatable pad 11 and is divided into a plurality of chamber segments (also, sometimes referred to herein as compartments or chamber members). For easy description, chamber segments will be referred to by various numerals throughout the specification, as they are identified. Although most chamber members will be understood to have both a longitudinal dimension (extending parallel to the length of the pad 11) and a transverse, or lateral, dimension (extending across the length of the pad 11), those which have a greater longitudinal than transverse dimension will be generally identified herein as longitudinal compartments 29 and those which have greater transverse than longitudinal dimension will be generally identified herein as transverse compartments 27. To avoid clutter only representative ones of the various compartments are labeled with the numerals 27, 29. Certain of the compartments are given unique numbers herein to more particularly identify them. The chamber segments cooperate with the outer pad structure to divide the inflatable pad into what will be referred to from time to time herein as areas or sections. For ease of description, areas/sections will be referred to by various numerals throughout the specification, as they are identified. Typically, a reference in this specification to a pad area or section will imply a corresponding inflatable chamber segment (or segments) associated with and selectively inflating the referenced area or section. Likewise, a reference in the specification to a chamber segment or member or compartment will imply a corresponding pad area or section inflated by the referenced to chamber segment.

The chamber segments of the FIG. 1 embodiment are seen to be primarily tubular, longitudinal compartments 29 with a tubular transverse compartment 27 at each of the ends 12, 14. The air retaining system 28 allows selective inflation of the inflatable pad 11 prior to, or after, the time that a person is placed upon the inflatable pad 11. The air retaining system 28 covers most of the stretcher 16 when the inflatable pad is secured thereto. The air retaining system 28 can be alternatively located on the surface of the pad body of the inflatable pad 1.

Further, the inflatable pad 11, as embodied herein, uses a compressed air source 30 with supply valve 31 and activation string 32 to selectively inflate the air retaining system 28. Other devices may be used to selectively inflate the interior of the inflatable pad 11, such as the provision of a port for a person to orally inflate the air retaining system 28, or other mechanical devices can be used which provide the compressed air necessary to inflate inflatable pad 11.

The inflatable pad 11 alternatively includes an intermediate binding member which binds the inflatable pad 11 to the backboard intermediate the ends 22, 24. The depicted binding member is a strap 26 which binds the inflatable pad 11 to the backboard 16.

Figures 2, 2A:
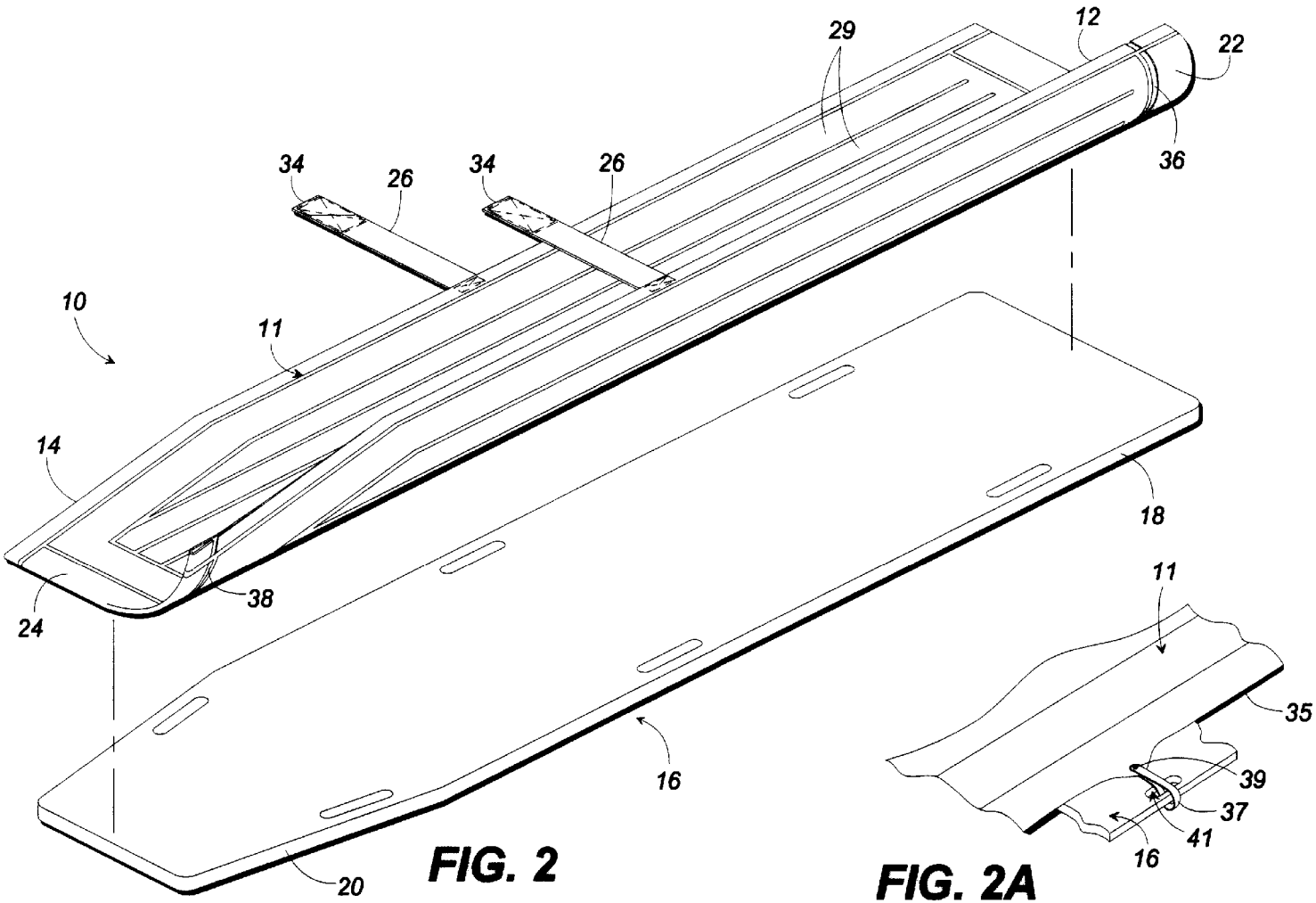
FIG. 2 is an exploaded, perspective view of the backboard assembly of FIG. 1, illustrating the inflatable pad above the backboard in operational relation thereto, and also showing the sleeves on the inflatable pad to slidably fit about the respective ends of the backboard.
FIG. 2A is an isolated view of one alternate connecting assembly for interconnecting the pad to the backboard.
Figure 3:
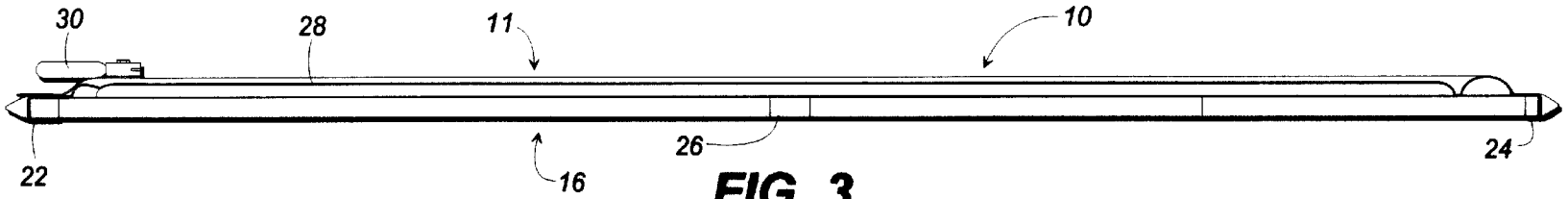
FIG. 3 is a side view of the backboard assembly of FIG. 1.

As shown in FIG. 2, the first depicted embodiment of the inflatable pad 11 has the sleeves 22 and 24 for slidably fitting about the respective ends 18 and 20 of the backboard 16, here embodied as pockets 36 and 38. The pockets 36 and 38 are respectively slid around ends 18 and 20 of the backboard 16 and the inflation of the inflatable pad 11 by compressed air source 30 causes the inflatable pad 11 to expand and pull in sleeves 22 and 24, thereby causing frictional engagement of pockets 36 and 38 on respective ends 18 and 20 of backboard 16. Thus, the sleeves 22, 24 function as grips to the backboard 16. It should be noted that the sleeves 22 and 24 can be sleeves, pockets, straps or other structures slidably fittable about or over the ends 18 and 20 of the backboard 16. It should be appreciated that in an alternate embodiment of this FIG. 1, the strap 26 is not employed as the sleeves 22 and 24 are relied upon to attach the inflatable pad 11 to the backboard 16.

In addition to the securement of the inflatable pad 11 to backboard 16 by sliding pockets 36 and 38 over ends 18 and 20 of the backboard 16, strap 26 of the inflatable pad 11 is wrapped around the backboard 16 whereby the hooks and loops of Velcro 34 mutually engage such that strap 26 binds the inflatable pad 11 to the backboard 16. It should be apparent that other connective structures can be substituted therefor, such as hooks, or a mechanical buckle. Other members can also be substituted for the strap 26 to bind the inflatable pad 11 to the backboard 16 such as the inclusion of a simple rope, instead of the strap, which is tied around the backboard 16; alternatively, other binding structures can be integrated into the inflatable pad 11 such that it connectably mates with enhancements on the backboard 16, such as Velcro being placed on respective sides of the backboard 16 and the inflatable pad 11, or simple adhesive may be used between the inflatable pad 11 and the backboard 16 which binds on contact. Referring to FIG. 2A, still another example of an acceptable, alternate interconnecting member used to releasably secure the pad 11 to the backboard 16 is a short loop-back strap 37, a plurality of which are strategically placed about the pad periphery 35. The loop-back strap 37, preferably, is releasably connected at one of its ends to a snap-button or rivet 39, then looped through a, for example, hand holding channel 41, or other channel, in the outer edge (sides, front and/or rear) of the backboard, and releasably connected at its second end to the snap button or rivet 39.

Figure 4:
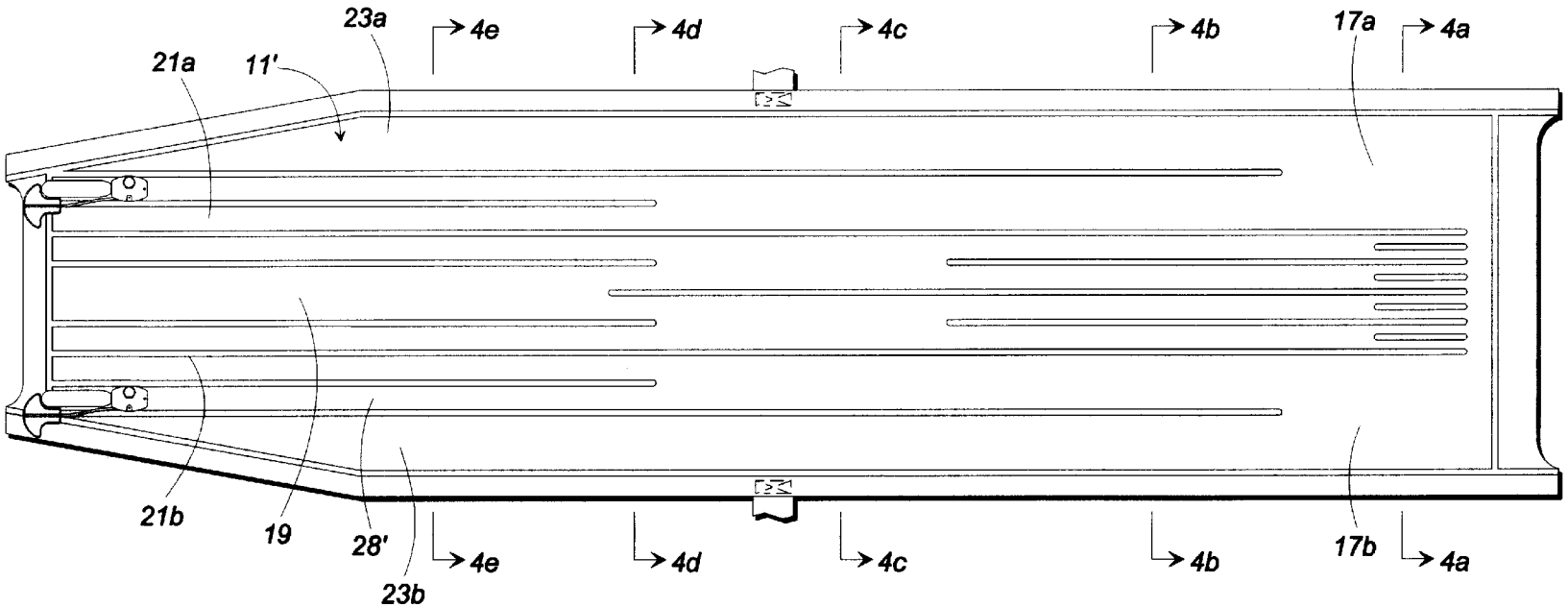
FIG. 4 is a top view of an alternate embodiment of the inflatable pad.
Figure 4D:
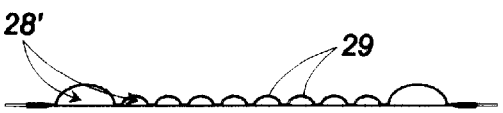
FIG. 4*d* is a cross-section of the gluteal section of the inflatable pad of FIG. 4.
Figure 4E:
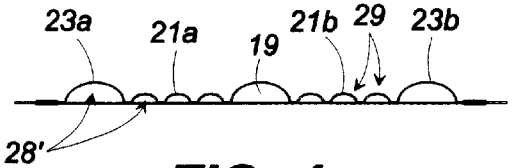
FIG. 4*e* is a cross-section of the leg section of the inflatable pad of FIG. 4.
Figure 4C:
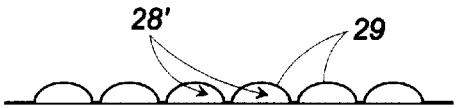
FIG. 4*c* is a cross-section of the lumbar section of the inflatable pad of FIG. 4.
Figure 4A:
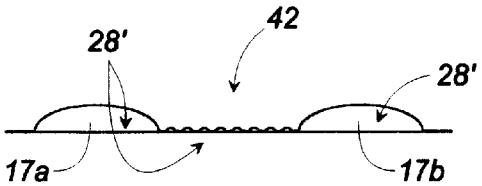
FIG. 4*a* is a cross-section of the head section of the inflatable pad of FIG. 4.
Figure 4B:
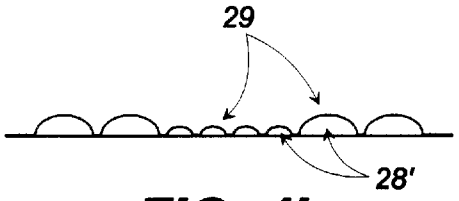
FIG. 4*b* is a cross-section of the thoracic section of the inflatable pad of FIG. 4.

An alternate embodiment of the inflatable pad 11' is shown in FIG. 4, and, preferably, includes a variety of cross-sectional profiles about its length, shown by FIGS. 4*a*–4*e,* to accommodate various sections of the body. FIG. 4*a* shows the head support area 54 of inflatable pad 11', noting the head-retaining chamber members 17*a* and 17*b* which prevent lateral motion of the head when restrained therein, and preferably a pillow support (not shown) is included under and on the sides of the neck; FIG. 4*b* shows a preferred support for the thoracic section of the back; FIG. 4*c* shows the preferred support for the lumbar section of the back; FIG. 4*d* shows a preferred support for the gluteal section; FIGS. 4*e* shows a preferred support for the legs, noting the leg separator extension 19 and the leg cradling sections 21*a,* 21*b* formed by the smaller longitudinal tubes between the separator extension tube 19 and the outer extension tubes 23*a,* 23*b.* The inflatable pad 11 maintains these profiles through inflation of the air compartments 29, shown in FIGS. 1 and 4, of the air retaining system 28'.

Figure 5:
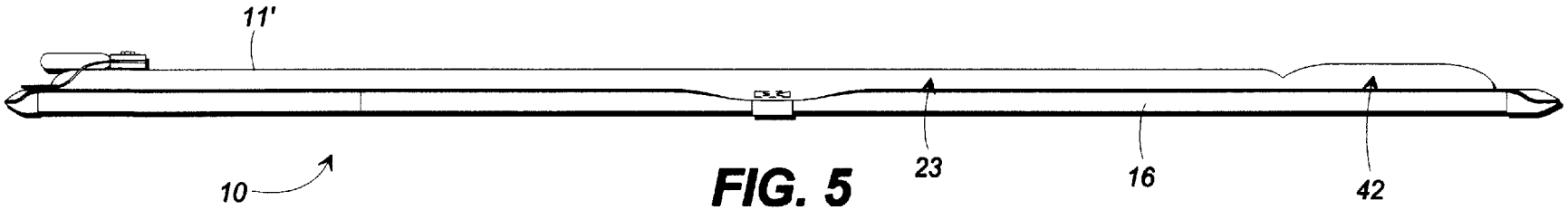
FIG. 5 is a side view of the backboard assembly of FIG. 4, illustrating the inflatable pad of FIG. 4 secured to the backboard.
Figure 6:
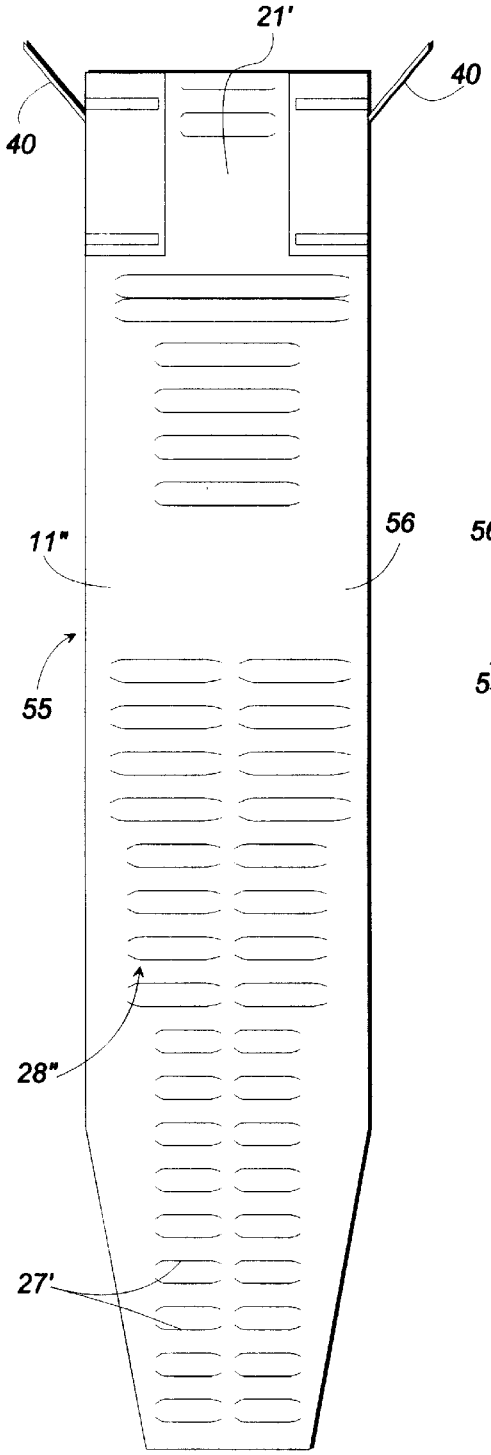
FIG. 6 is a top view of a second alternate embodiment of the inflatable pad.

Further, the inflatable pad 11' has a longitudinal profile, shown in FIG. 5, which includes the head supporting area 54 and the torso-supporting area 25. The head supporting area 54 is particularly raised to restrain the lateral motion of the head, as also shown in FIG. 4*a*.

Figure 7:
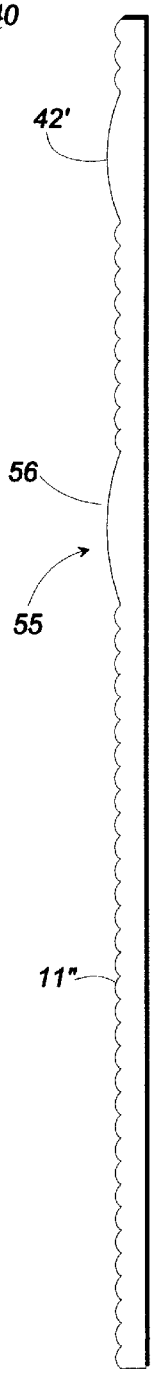
FIG. 7 is a side view of the inflatable pad of FIG. 6.
Figure 7A:
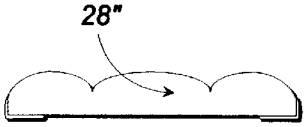
FIG. 7*a* is a cross-section of the head section of the inflatable pad of FIG. 6.
Figure 7B:
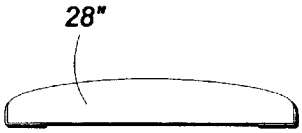
FIG. 7*b* is a cross-section of the lumbar-support section of the inflatable pad of FIG. 6.
Figure 7C:
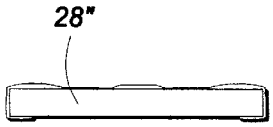
FIG. 7*c* is a cross-section of the leg section of the inflatable pad of FIG. 6.

A further alternate embodiment of the inflatable pad 11" is shown in FIGS. 6 and 7*a–c.* The alternately preferred cross-section of the transverse air compartments 27' are shown throughout FIGS. 7*a–c.* FIG. 7*a* shows the head section 42' of the inflatable pad 11"; FIG. 7*b* shows the lumbar-supporting section of the inflatable pad 11"; FIG. 7*c* shows the leg-supporting section of the inflatable pad 11". This embodiment of the inflatable pad 11" further includes straps 40 about the head support area 54' to assist in attaching the inflatable pad 11" to the backboard 16.

Figure 8:
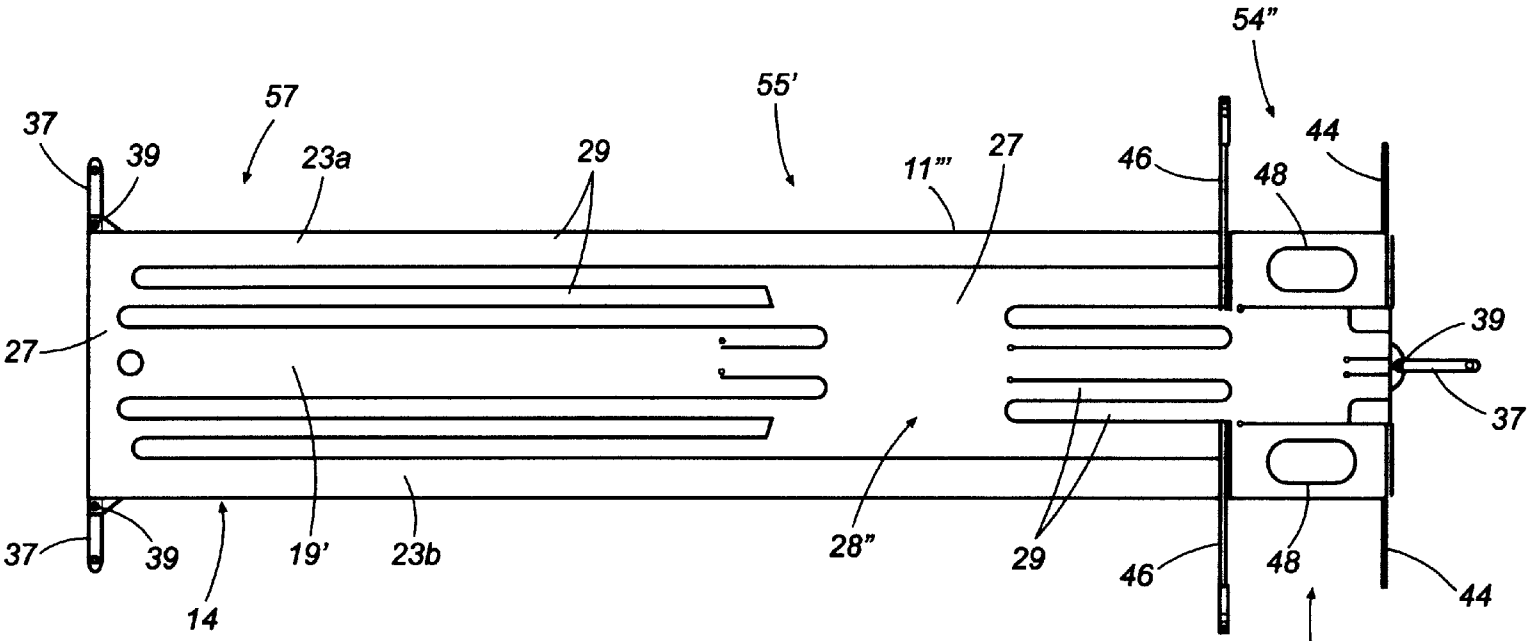
FIG. 8 is a top view of a third alternate embodiment of the inflatable pad illustrating a head restraint.
Figure 8A:
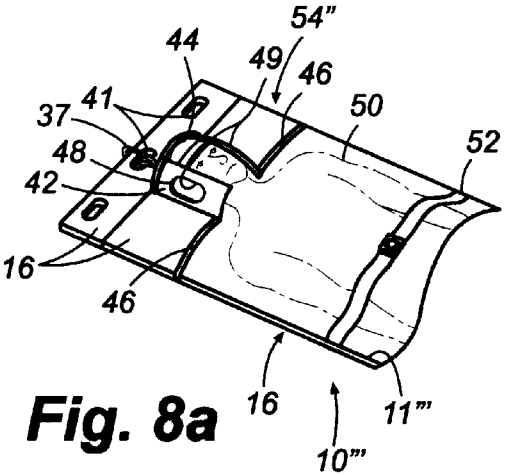
FIG. 8*a* is an isolated perspective view of a person immobilized on the backboard assembly including the inflatable pad of FIG. 8 illustrating the person's head being held within the head restraint.

Yet a further alternate embodiment of the inflatable pad 11'" is shown in FIGS. 8–8*a*. Inflatable pad 11'" includes a head support area 54" defining a head restraint section 42. The head restraint section 42 is comprised of side panels 48, preferably having earholes 49, which are affixed about the head of a person 50 held upon the assembly, as particularly shown in FIG. 8*a*. The side panels 48 are secured about the head by a pair of straps 44. An alternate pair of straps 46 are used to secure inflatable pad 11'" to the backboard 16. In FIG. 8*a,* the person 50 is shown as secured to the backboard assembly 10'" through the use of a strap 52. Note that the backboard assembly 16 and the related backboard and pad are more rectangular in planar view than are the other depicted embodiments.

Figure 9:
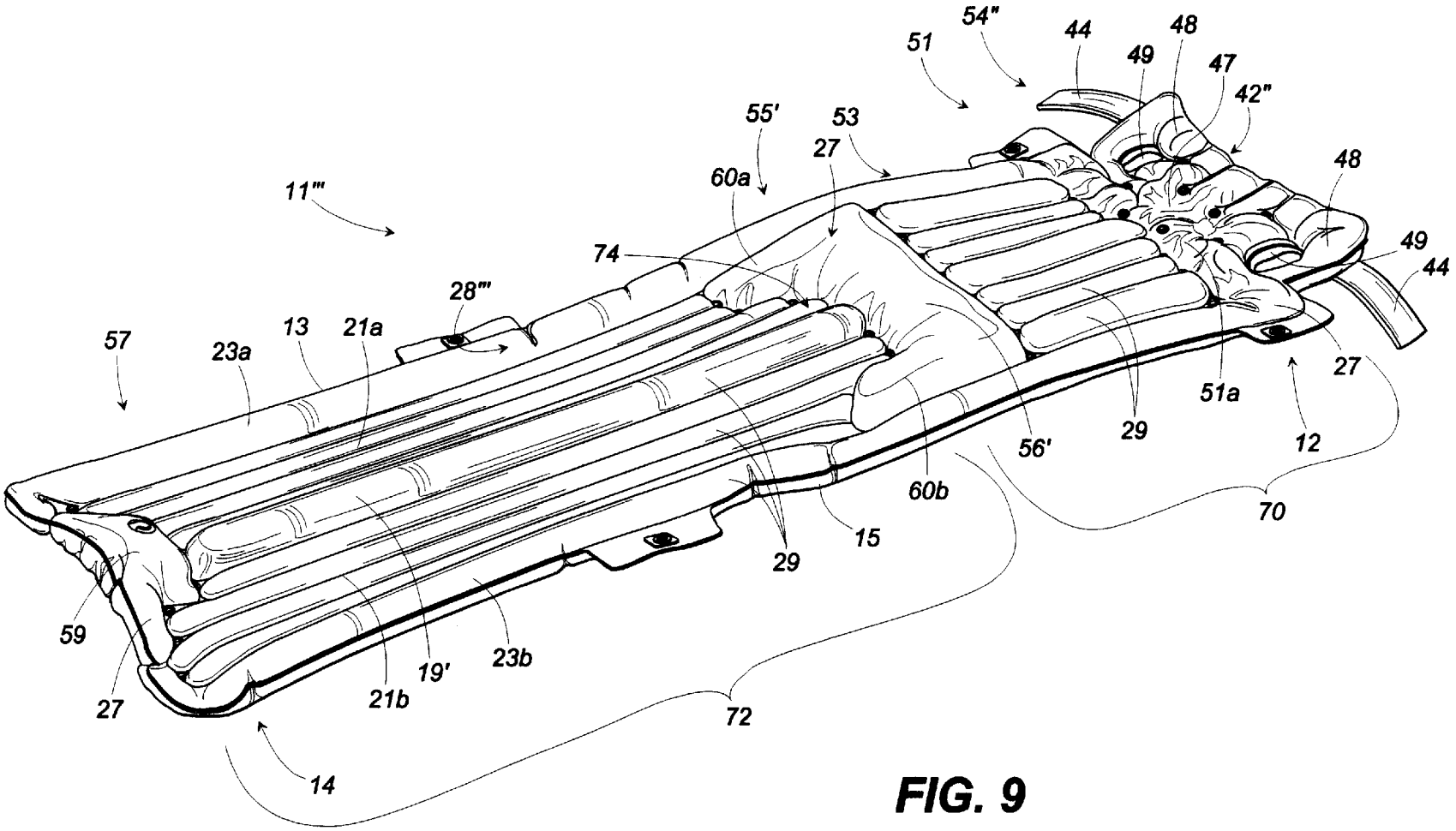
FIG. 9 is a perspective view of the inflatable pad of FIG. 8, showing an alternate extremity support area.

FIG. 9 is a perspective view of the pad 11'" embodiment of FIG. 8 (with an alternately structured foot end 14), which view assists in depicting the head support area 54" (including, among other structure, the head restraint section 42 with side panels 48 and earholes 49, and the occipital padding section 47), the cervical support area 51 (including, among other structure, a transverse cervical support pillow 51*a*), the thoracic support area 53 (where the outermost tubes are slightly larger than the adjacent tubes), the lumbar support area 55 (including, among other structure, a transverse pillow section 56 for lumbar support and longitudinal pillow sections 60*a,* 60*b* for hip support and cradling), and the extremity support area 57. The extremity support area 57 includes a tubular leg separator compartment 19 which is slightly larger than the adjacent tubes (of which other embodiments have a similar structure) as are the outer tubes 23*a,* 23*b,* thus defining the leg cradling segments 21*a,* 21*b.* The extremity support area 57 of the FIG. 9 embodiment includes an alternate enlarged foot support pillow 59.

Referring again to FIG. 9, this embodiment of the inflatable pad 11'" is shown having a top end 12, a bottom end 14, and two sides 13, 15. The pad 11'" is formed with an air retaining system 28'", including a plurality of inflatable chamber members, integrated within the pad structure. The chamber segments mentioned below are, for convenience, identified by the same numerals as the pad areas they inflate. A lateral pillow chamber member 56' of a lumbar support chamber segment 55 is positioned intermediate the pad ends 12, 14, thus dividing the pad into two sections, an upper body support section 70 and a lower body support section 72. In the upper body support section 70, are located a cervical support chamber segment 51 including a lateral pillow chamber member 51*a,* a thoracic support chamber segment 53, and a head support chamber segment 54". The head support chamber segment 54 includes an occipital padding chamber segment 47, and a pair of side panel chamber segments 48. An aperture 49 is formed through each side panel chamber segment 48 for the purpose of earholes.

The lumbar support chamber segment 55 further comprises two longitudinal pillow chamber segments 60*a,* 60*b,* each located at the opposing ends of the lateral chamber member 56. A hip support chamber segment 74 is defined by and between the two longitudinal pillow chamber segments 60*a,* 60*b.* There are two border chamber segments 23*a,* 23*b,* running longitudinally along the length of the pad. One border chamber segment is adjacent to each lateral pillow chamber segments 60*a,* 60*b.*

In the lower body support section 72, are located the hip support chamber segment 74, and a pair of leg cradling chamber segments 21*a,* 21*b,* separated by a leg separator chamber segment 19. The hip support chamber segment 74 is located adjacent to the lateral chamber segment 56. There is an extremity support chamber segment 57 adjacent to the bottom end of the lower body support section 72. The extremity support chamber segment 57 further comprises an enlarged foot support chamber segment 59 at the lower end of the pad.

In each of the preferred embodiments, the air retaining system 28 is preferably formed as a single, continuous chamber which winds throughout the various chamber members 29, 29'. As such, the pad 11 "automatically adjusts" to the body contour of the patient 50 by displacing air from one pad area/section to another. Alternate less preferred embodiments acceptably include a plurality of independent chambers which are, for example, separately inflated.

While there has been shown a preferred and alternate embodiments of the present invention, it will be clear to those skilled in the art that various modifications, additions, deletions, and improvements may be made to the illustrated embodiments without departing from the scope and spirit of the invention as set forth in the claims appended herewith. In addition, the corresponding structures, materials, acts, and equivalents of all means or step plus function elements in the claims are intended to include any structure, material, or act for performing the functions in combination with other claimed elements, as specifically claimed herein.

What is claimed is:

1. A pad for releasable attachment to a backboard to provide cushioned support to substantially an entire human body, said pad comprising:

a pad structure having a length defined between a top end and a bottom end, and a width defined between a first side and a second side; and a selectively inflatable air retaining chamber structure integrated with said pad structure, whereby inflation of said chamber structure inflates at least portions of said pad structure, said chamber structure comprising, at least, a lumbar support chamber segment defined by at least an inflatable first lateral chamber member extending transverse to the length of said pad structure, intermediate said first side and said second side, and intermediate said top end and said bottom end, whereby the pad structure is further defined by an upper body support section between the first lateral chamber member and the top end and a lower body support section between the first lateral chamber member and the bottom end, a first plurality of inflatable longitudinal chamber members extending longitudinally intermediate said top end and said first lateral chamber member, whereby a thoracic support chamber segment is defined at the upper body support segment of the pad structure, a second plurality of inflatable longitudinal chamber members extending longitudinally intermediate said bottom end and said first lateral chamber member, whereby a lower body support chamber segment is defined at the lower body support section of the pad structure, a head support chamber segment extending from said top end of said pad structure and being defined by at least an inflatable occipital padding chamber member, and a leg support chamber segment comprising a leg separator chamber segment having a tubular form extending longitudinally along the length of said pad structure and intermediate said first and said second sides of said pad structure, a first cradling chamber segment defined by a plurality of tubular chambers extending longitudinally along the length of said pad structure between said leg separator chamber segment and said first side of said pad structure, and a second cradling chamber segment defined by a plurality of tubular chambers extending longitudinally along the length of said pad structure between said leg separator chamber segment and said second side of said pad structure; and wherein said lumbar support chamber segment is further defined by a first longitudinal pillow chamber member and a second longitudinal pillow chamber member, each said longitudinal pillow chamber member extending longitudinally from said first lateral chamber member toward said bottom and of said the pad structure, said first longitudinal pillow chamber member and said second longitudinal pillow chamber member being displaced laterally from one another, whereby a hip support chamber segment associated with said lumbar support chamber segment is defined.

2. The pad of claim 1, wherein said head support chamber segment is further defined by an inflatable first side panel chamber member connected to and laterally adjacent said occipital padding chamber member and an inflatable second side panel chamber member connected to and laterally adjacent said occipital padding chamber member, opposing said first side panel chamber member, each said side panel chamber member including an aperture formed in therethrough, and a strap attached to each said side panel chamber member.

3. The pad of claim 1, wherein said chamber structure further comprises a cervical support chamber segment defined by at least an inflatable second lateral chamber member extending transverse to the length of said pad structure adjacent said top end and positioned between said thoracic support chamber segment and said head support chamber segment.

4. The pad of claim 1, whereby said second plurality of inflatable longitudinal chamber members comprises:

at least one leg separator chamber member being generally tubular in shape and positioned generally centrally between said first side and said second side of said pad structure;

and least one leg cradling chamber member positioned to a first side of said leg separator chamber member, and at least one leg cradling chamber member positioned to a second side of said leg separator chamber member, each said leg cradling chamber member being generally tubular in shape, wherein said leg separator chamber member has a thickness larger than a thickness of each leg cradling chamber members, whereby said lower body support chamber segment provides for separation and separate support of the legs of a human body positioned on the pad structure.

5. The pad of claim 4, wherein said chamber structure further comprises:

a longitudinal first border chamber member adjacent said first side of said pad structure and extending substantially the length of said pad structure from said top end to said bottom end of said pad structure; and a longitudinal second border chamber member adjacent said second side of said pad structure and extending substantially the length of said pad structure from said top end to said bottom end of said pad structure.

6. The pad of claim 1, wherein said chamber structure further comprises an extremity support chamber segment adjacent said bottom end of said pad structure and being defined by at least a foot support chamber member positioned adjacent said bottom end and generally centrally between said first side and said second side of said pad structure.

7. The pad of claim 1, wherein said chamber structure further comprises:

a longitudinal first border chamber member adjacent said first side of said pad structure and extending substantially the length of said pad structure from said top end to said bottom end of said pad structure; and a longitudinal second border chamber member adjacent said second side of said pad structure and extending substantially the length of said pad structure from said top end to said bottom end of said pad structure.

8. The pad of claim 1 wherein each chamber member of said chamber structure is in fluid flow communication with each other said chamber member, either directly or through intercommunication with another of said chamber members.

9. The pad of claim 1, wherein at least one chamber segment being independently inflatable.

10. A pad for releasable attachment to a backboard to provide cushioned support to substantially an entire human body, said pad comprising:

a pad body having a length, a top end, a bottom end, a first side and a second side; and a selectively inflatable air retaining chamber system integrated with said pad body, whereby inflation of said air retaining chamber system inflates at least portions of said pad body, said air retaining chamber system being contoured for anatomic support and comprising, at least, a head support chamber segment defined by at least an inflatable occipital padding chamber segment connected to said top end and having a first end and a second end, a first side panel chamber segment attached to said first end and a second side panel chamber segment attached to said second end, a first strap attached to said first side panel chamber segment, and a second strap attached to said second side panel chamber segment, a cervical support chamber segment adjacent said top end, said cervical support chamber segment further comprising a cervical support pillow chamber segment extending between said first and second side of said pad body and transverse to the length of said pad body, and leg support chamber segment comprising a leg separator chamber segment having a tubular form extending longitudinally along the length of said pad body and intermediate said first and said second sides of said pad body, a first cradling chamber segment defined by a plurality of tubular chambers extending longitudinally along the length of said pad body between said leg separator chamber segment and said first side of said pad body, and a second cradling chamber segment defined by a plurality of tubular chambers extending longitudinally along the length of said pad body between said leg separator chamber segment and said second side of said pad body.

11. The pad of claim 10 further comprising:

a top pocket and a bottom pocket integrated to said pad body and positioned adjacent said top and bottom ends, respectively, of said pad body, wherein said pockets slidably engage top and bottom ends of the stretcher and secure said pad body to the stretcher upon the inflation of said air retaining chamber system of said pad body.

12. The pad of claim 10, wherein said air retaining chamber system further comprises a thoracic support chamber segment adjacent said cervical support chamber segment, said thoracic support chamber segment comprising a plurality of substantially parallel tubular chamber segments placed longitudinally along said length of said pad body, wherein the diameter of outermost tubular chamber segments are larger than the diameter of inner adjacent tubular chamber segments.

13. The pad of claim 12, wherein said air retaining chamber system further comprises a lumbar support chamber segment adjacent said thoracic support chamber segment and opposing said cervical support chamber segment, said lumbar support chamber segment comprising a first pillow chamber segment extending between said first and second side of said pad body and transverse to the length of said pad body, and a pair of lateral pillow chamber segments extending longitudinally along the length of said pad body, said lateral pillow chamber segments connecting to said first pillow chamber segment.

14. The pad of claim 10, wherein said air retaining chamber system further comprises an extremity support chamber segment defined between said leg support chamber segment and the bottom end of the pad body, said extremity support chamber segment comprising a foot support pillow chamber segment extending between said first side and said second side of said pad body.

15. The pad of claim 10, wherein at least one chamber segment being independently inflatable.

16. A pad for releasble attachment to a backboard to provide cushioned support to substantially an entire human body, said pad comprising a pad body having a length, a top end and a bottom end, a first side and a second side, and a selectively inflatable air retaining chamber system integrated with said pad body, whereby inflation of said air retaining chamber system inflates at least portions of said pad body, said air retaining chamber system comprising:

a cervical support chamber segment, said cervical support chamber segment being adjacent said top end;

a lumbar support chamber segment defined by a pillow chamber segment extending between the first side and the second side of the pad body, traverse to the length of said pad body and intermediate the top end and the bottom end, wherein said lumbar support chamber segment is further defined by a first longitudinal pillow chamber member and a second longitudinal pillow chamber member, each said longitudinal pillow chamber member extending longitudinally from said first lateral chamber member toward said bottom end of said the pad structure, said first longitudinal pillow chamber member and said second longitudinal pillow chamber member being displaced laterally from one another, whereby a hip support chamber segment associated with said lumbar support chamber segment is defined; and a thoracic support chamber segment defined by a plurality of substantially parallel chambers extending longitudinally between said cervical support chamber segment and said lumbar support chamber segment and along the length of said pad body.

17. The pad of claim 16, wherein said air retaining chamber further comprises a head support chamber segment, said head support chamber segment comprising an occipital padding chamber segment with a first end and a second end and connected to said cervical support chamber segment, and a pair of side panel chamber segments connected to said occipital padding chamber segment through said first and second ends, each said side panels chamber segment having an aperture formed in therethrough.

18. A pad for releasable attachment to a backboard to provide cushioned support to substantially an entire human body, said pad comprising a pad body having a length, a top end and a bottom end, a first side and a second side, and a selectively inflatable air retaining chamber system integrated with said pad body, whereby inflation of said air retaining chamber system inflates at least portions of said pad body, said air retaining chamber system comprising:

a cervical support chamber segment, said cervical support chamber segment being adjacent said top end;

a lumbar support chamber segment defined by a pillow chamber segment extending between the first side and the second side of the pad body, traverse to the length of said pad body and intermediate the top end and the bottom end; and a thoracic support chamber segment defined by a plurality of substantially parallel chambers extending longitudinally between said cervical support chamber segment and said lumbar support chamber segment and along the length of said pad body; and wherein said air retaining chamber system further comprises a leg support chamber segment defined between said lumbar support chamber segment and the bottom end of said pad body, said leg support chamber comprising two leg cradling chamber segments separated by a leg separator chamber segment, each said cradling chamber segment comprising a plurality of substantially parallel tubular chambers extending longitudinally, said leg separator chamber segment comprising a singular tubular chamber of a diameter larger than diameters of parallel tubular chamber of said cradling chamber segments and extending longitudinally.

19. A pad for use with a stretcher to provide cushioned support, said pad comprising a pad body having a length, a top end, a bottom end, a first side, a second side, and a selectively inflatable continuous air retaining chamber integrated to said pad body, whereby inflation of said air retaining chamber inflates at least portions of said pad body, said air retaining chamber comprising:

a first outer chamber segment adjacent said first side extending along the length of said pad body;

a second outer chamber segment adjacent said second side extending along the length of said pad body;

a leg separator chamber segment having a tubular form, intermediate said first outer chamber segment and said second outer chamber segment; and a pair of leg cradling chamber segments extending between said leg separator chamber segment and said first outer chamber segment, and between said leg separator chamber segment and said second outer chamber segment, said leg cradling chamber segments comprising a plurality of substantially parallel tubular chamber segments placed longitudinally along the length of said pad body, said leg separator chamber segment and said outer chamber segments being larger than adjacent said tubular chamber segments of said cradling chamber segments.

20. The pad of claim 19, wherein said air retaining chamber further comprises an extremity support chamber segment extending between said first outer chamber segment and said second outer chamber segment and transverse to the length of said pad body.

21. A pad for releasable attachment to a backboard to provide cushioned support to substantially an entire human body, said pad comprising:

a pad structure having a length defined between a top end and a bottom end, and a width defined between a first side and a second side; and a selectively inflatable air retaining chamber structure integrated with said pad structure, whereby inflation of said chamber structure inflates at least portions of said pad structure, said chamber structure comprising, at least, a lumbar support chamber segment defined by at least an inflatable first lateral chamber member extending transverse to the length of said pad structure, intermediate said first side and said second side, and intermediate said top end and said bottom end, whereby the pad structure is further defined by an upper body support section between the first lateral chamber member and the top end and a lower body support sections between the first lateral chamber member and the bottom end, a first plurality of inflatable longitudinal chamber members extending longitudinally intermediate said top end and said first lateral chamber member, whereby a thoracic support chamber segment is defined at the upper body support segment of the pad structure, a second plurality of inflatable longitudinal chamber members extending longitudinally intermediate said bottom end and said first lateral chamber member, whereby a lower body support chamber segment is defined at the lower body support section of the pad structure, a head support chamber segment extending from said top end of said pad structure and being defined by at least an inflatable occipital padding chamber member, and at least one leg separator chamber member being generally tubular in shape and positioned generally centrally between said first side and said second side of said pad structure.

22. A pad for releasable attachment to a backboard to provide cushioned support to substantially an entire human body, said pad comprising:

a pad body having a length, a top end, a bottom end, a first side and a second side; and a selectively inflatable air retaining chamber system integrated with said pad body, whereby inflation of said air retaining chamber inflates at least portions of said pad body, said air retaining chamber system being contoured for anatomic support and comprising, at least, a head support chamber segment defined by at least an inflatable occipital padding chamber segment connected to said top end and having a first end and a second end, a first side panel chamber segment attached to said first end and a second side panel chamber segment attached to said second end, a first strap attached to said first side panel chamber segment, and a second strap attached to said second side panel chamber segment, a cervical support chamber segment adjacent said top end, said cervical support chamber segment further comprising a cervical support pillow chamber segment extending between said first and second side of said pad body and transverse to the length of said pad body, and a lumbar support chamber segment comprising a first pillow chamber segment extending between said first and second side of said pad body and transverse to the length of said pad body, and a pair of lateral pillow chamber segments extending longitudinally along the length of said pad body, said lateral pillow chamber segments connecting to said first pillow chamber segment.

23. The pad of claim 22, wherein at least one chamber segment being independently inflatable.

* * * * *